United States Patent [19]

Fujita

[11] Patent Number: 4,939,875

[45] Date of Patent: Jul. 10, 1990

[54] FOLDING STAGE SYSTEM

[76] Inventor: Kazuo Fujita, 1-1, Hagiyamadai, Seto-shi, Aichi-ken,, Japan

[21] Appl. No.: 315,847

[22] Filed: Feb. 27, 1989

[30] Foreign Application Priority Data

Aug. 27, 1988 [JP] Japan ..... 63-213412

[51] Int. Cl.[5] ..... E04H 3/24

[52] U.S. Cl. ..... 52/7

[58] Field of Search ..... 52/7

[56] References Cited

FOREIGN PATENT DOCUMENTS 59-120395 1/1986 Japan .

60-298461 7/1987 Japan .

*Primary Examiner*—John E. Murtagh

*Attorney, Agent, or Firm*—Fred Philpitt

[57] ABSTRACT

A folding stage system comprises guide posts fixed to (i) a support wall structure, (ii) a stage, (iii) a proscenium wall having a central opening and fixed to the stage (iv) side link mechanisms connecting upper portions of opposed sides of the proscenium wall to outermost ones of the guide posts and (v) a central link mechanism connecting the top of the proscenium wall to the tops of the guide posts. The stage includes central stage components associated with central ones of the guide posts. Side guide posts may be provided between the central guide posts and the outermost guide posts, and side stage components may be associated with the respective side guide posts. Each central stage component is provided with mechanisms for folding the central stage component to a vertical position adjacent to the associated central guide post and unfolding it to a horizontal position on a floor. Also, each side link mechanism permits folding of the side link mechanism to a vertical position adjacent to the associated outermost guide post and unfolding it to a horizontal position above the floor. The upper portions of the opposed sides of the proscenium wall are connected to front end portions of the side link mechanisms. The proscenium wall is moved backward simultaneously when the stage components and the side link mechanisms are folded, and is moved forward simultaneously when they are unfolded.

11 Claims, 7 Drawing Sheets

FOLDING STAGE SYSTEM

FIELD OF THE INVENTION

This invention relates to a folding stage system which may be compactly folded to a vertical position immediately in front of a support wall structure and may be unfolded forward to provide a relatively large stage.

BACKGROUND OF THE INVENTION

In either of Japanese Patent Applications Nos. 59-120395 (published Jan. 7, 1986 under No. 61-1769) and 60-298461 (published July 16, 1987 under No. 62-160371) the inventor hereof has proposed a folding stage system of a type similar to the type of a folding stage system which will be proposed herein, that is, a stage system which includes guide posts fixed to a support wall structure and may be compactly folded to a vertical position immediately in front of the support wall structure and unfolded forward to provide a relatively large stage. The stage system proposed in the application No. 60-298461 has a central foldable link mechanism and foldable side link mechanisms which connect a proscenium wall to the support wall structure, whereas the stage system proposed in the application No. 59-120395 has no such mechanisms. On the other hand, a feature common to the two prior arts is that when the stage system is folded, rear portions of stage components associated with the respective guide posts are lifted along the heights of the guide posts while the proscenium wall is moved toward the support wall structure, maintaining an upright position thereof. After use either prior stage system may be compactly folded, or stored, to the vertical position immediately before the support wall structure and, hence, the greater part of the space occupied by the stage system may be freely used. When the stage system is unfolded, the tops of the stage components are lowered while the entire stage components are moved to horizontal positions and the proscenium wall is moved forward. Either prior stage system is not merely such a flexible system, but also provides a massive and stable stage comparable to a usual fixed-type stage originally constructed in a building.

After proposing the prior stage systems, the inventor reexamined them to see if they do not have any disadvantages which may be eliminated. As a result, the inventor has found that the mechanism for operating the stage components and the proscenium wall may be made more compact and more efficient. In addition, in the stage system proposed in the application No. 60-298461, since the proscenium wall is moved by rotating wheels provided in conjunction with the bottom of the proscenium wall by motors, the upper portion thereof may quake while the proscenium wall is being moved. The side link mechanisms which connect the proscenium wall to the support wall structure is not sufficient to prevent it. Thus the proscenium wall may not be moved stably.

SUMMARY OF THE INVENTION

It is an object of the invention to provide a folding stage system with more compact and more efficient mechanisms for operating stage components and a proscenium wall than in the prior art.

Another object of the invention is to provide a folding stage system wherein the whole of a proscenium wall may be moved stably with no portion thereof quaking.

Other objects and advantages of the invention will become apparent upon reading a detailed disclosure of the invention which will follow.

According to the invention, a folding stage system is provided which includes guide posts, a stage, a proscenium wall, side link mechanisms and a central link mechanism. The guide posts are fixed to an indoor or outdoor support wall structure, and includes central guide posts and outermost guide posts. The stage includes central stage components associated with the respective central guide posts. In addition, side guide posts may be provided between the central guide posts and the outermost guide posts, and side stage components may be associated with the respective side guide posts. Each stage component is connected to an inner structure of the associated guide post to allow the rear portion of the stage component to move in vertical directions. Each stage component has a platform and support legs pivotally connected thereto. Each central stage component, in addition, includes mechanisms for folding and unfolding the stage component. Each folding mechanism includes a geared motor. Wheels are provided in conjunction with foremost support legs of each stage component to enable the stage component to move smoothly on a floor. The proscenium wall is fixed to the foremost support legs of the stage components at a lower portion thereof. The proscenium wall is also provided with wheels at the bottom thereof. Opposed sides of the proscenium wall are connected at upper portions thereof to the respective outermost guide posts by the side link mechanisms. The construction of each side link mechanism is substantially the same as that obtained if the central stage component were turned upside down, except that the side link mechanism and the proscenium wall are connected by connecting means of relatively large masses. Each side link mechanism is also provided with mechanisms for folding and unfolding the side link mechanism. Each folding mechanism includes a geared motor. The top of the proscenium wall may be connected to the tops of the central and side guide posts by a foldable central link mechanism. Means may be suspended from the central link mechanism for hanging curtains.

When the stage system is to be folded, the geared motors of the central stage components and of the side link mechanisms are operated. Then, the rear ends of the central stage components move upward while the rear ends of the side link mechanisms move downward. The side stage component is connected to the side link mechanism in such a manner that the lowering of the rear end of the side link mechanism causes the rear end of the side stage component to move upward. All the stage components and the side link mechanisms are thus folded to vertical positions adjacent to the guide posts. Since the proscenium wall is connected to the stage components at the lower portion thereof and to the side link mechanisms at the upper portions thereof, the proscenium wall moves toward the guide post simultaneously when the stage components and the side link mechanisms are folded. But the proscenium wall is in a vertical position at all times. The proscenium wall is stored to a position immediately in front of the guide posts.

When the stage system is to be unfolded, the geared motors are rotated in directions opposite to the directions in which the geared motors are rotated to fold the stage system. Then, the tops of the stage components move downward while the tops of the side link mechanisms move forward. The stage components and the side link mechanisms are thus unfolded to the horizontal positions. Simultaneously the proscenium wall moves forward.

BRIEF DESCRIPTION OF THE DRAWINGS

FIG. 1 is a partially cutaway perspective view of the stage system;

FIG. 2 is a side view of the stage system. Since FIG. 2 depicts an outermost guide post and a central guide post as a single continuous member for convenience sake, FIG. 2 is a partially imaginary view;

FIG. 3 is a side view in which a central stage component is folded to a vertical position;

FIG. 4 is a side view in which a side link mechanism is folded to a vertical position;

FIG. 5 is a partially cutaway perspective view of the central guide post and the central stage component associated therewith;

FIG. 6 is a rear elevation of the central guide post and the associated central stage component. In FIG. 6 the central guide post is depicted in its longitudinal section;

FIG. 7 shows inner structures of the central guide post, of a side guide post and of the outermost guide post.

DETAILED DESCRIPTION OF PREFERRED EMBODIMENTS

Two different embodiments of the invention, namely, high-type and low-type folding stage systems will now be described with reference to the drawings.

I. High-type folding stage system

Figure 1:
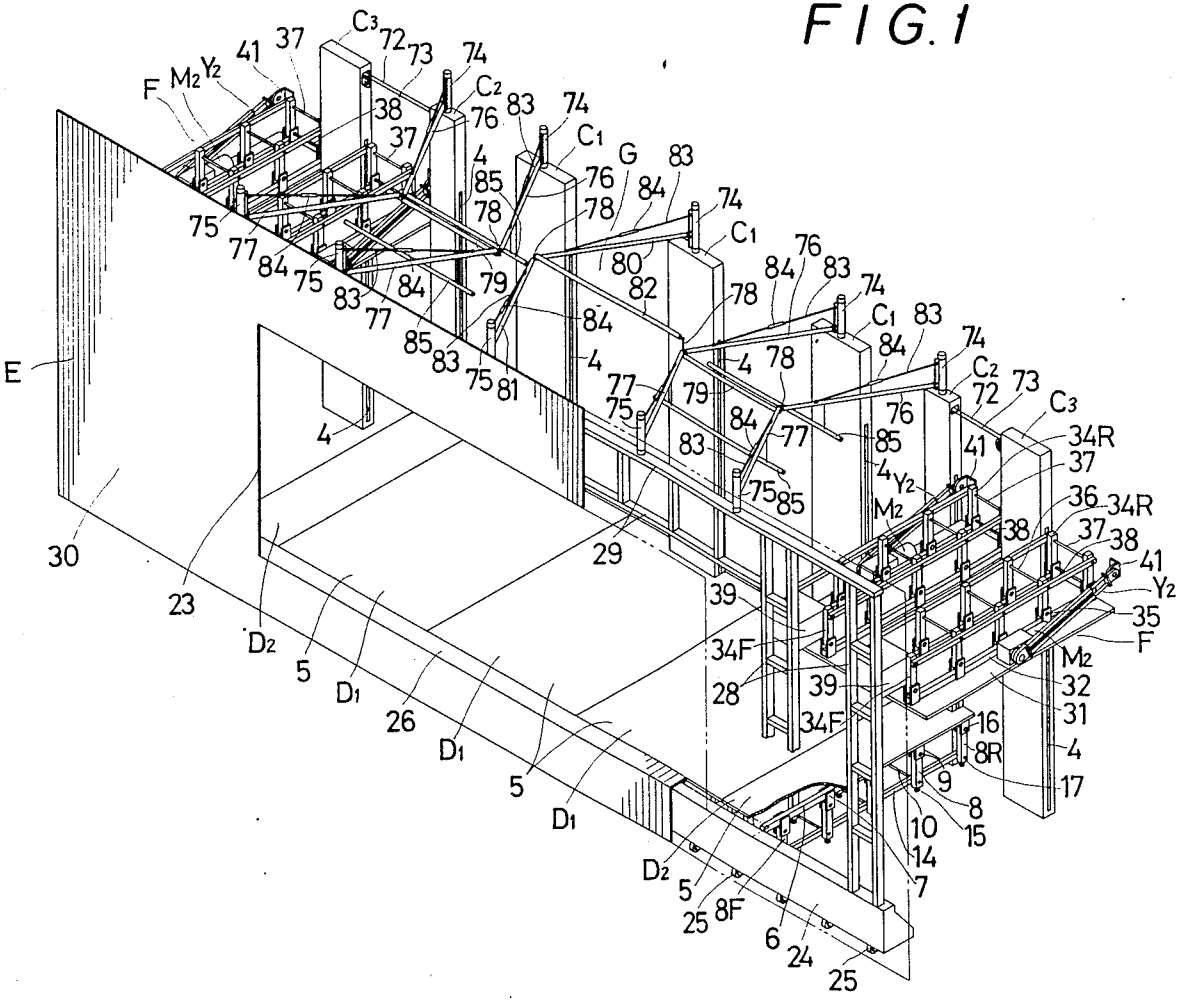
FIGS. 1 to 7 depict a high-type folding stage system according to the invention.
Figure 2:
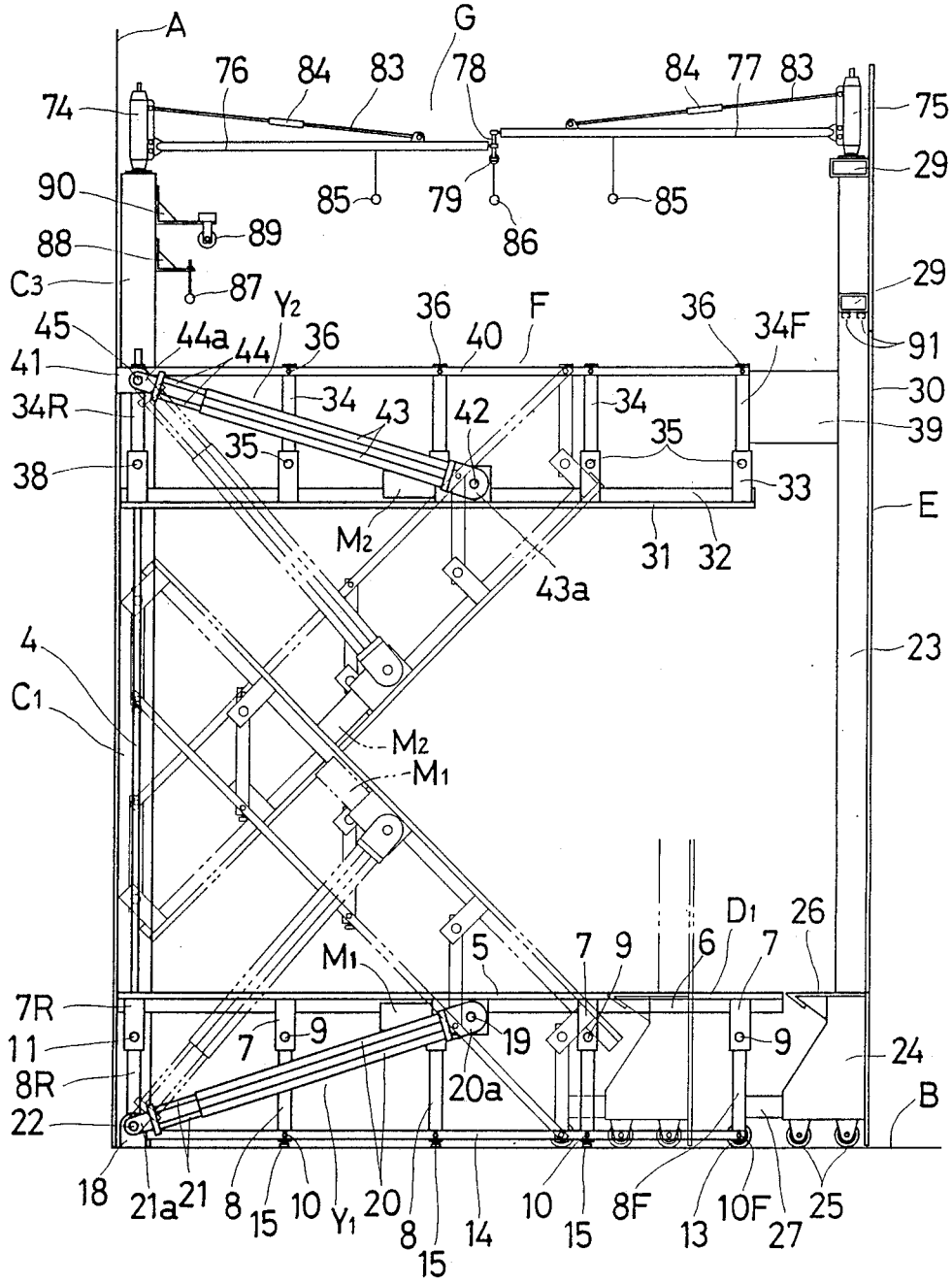
Figure 3:
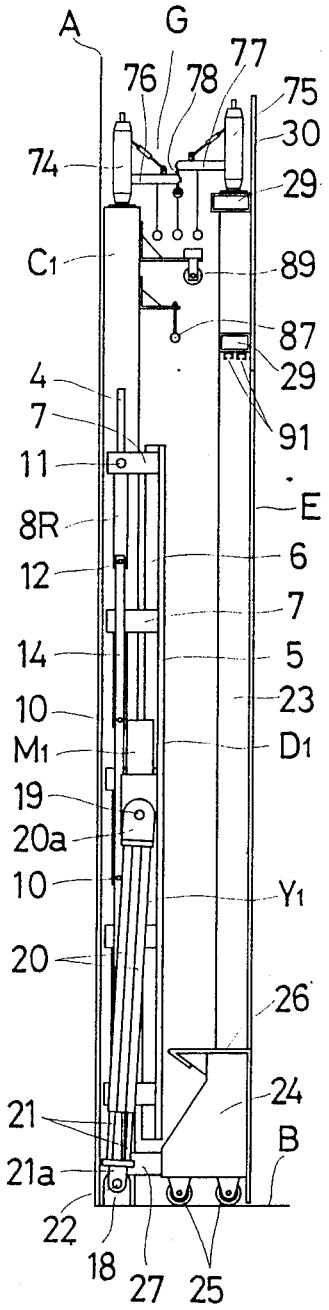
Figure 4:
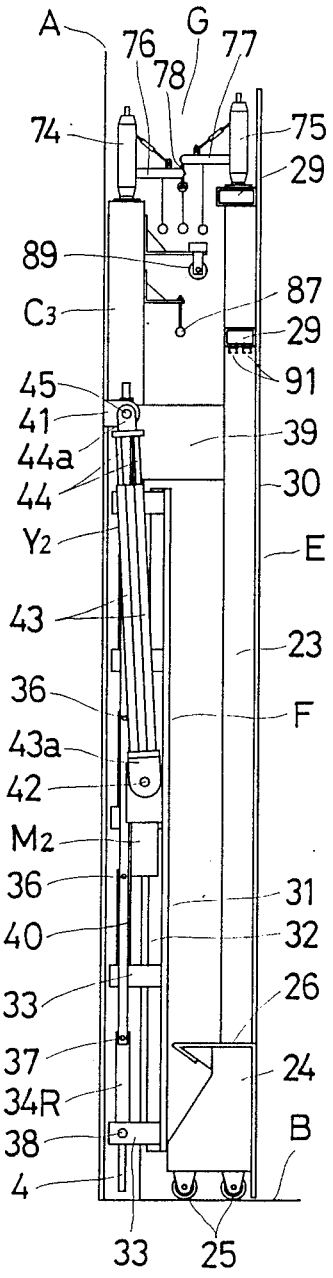
Figure 5:
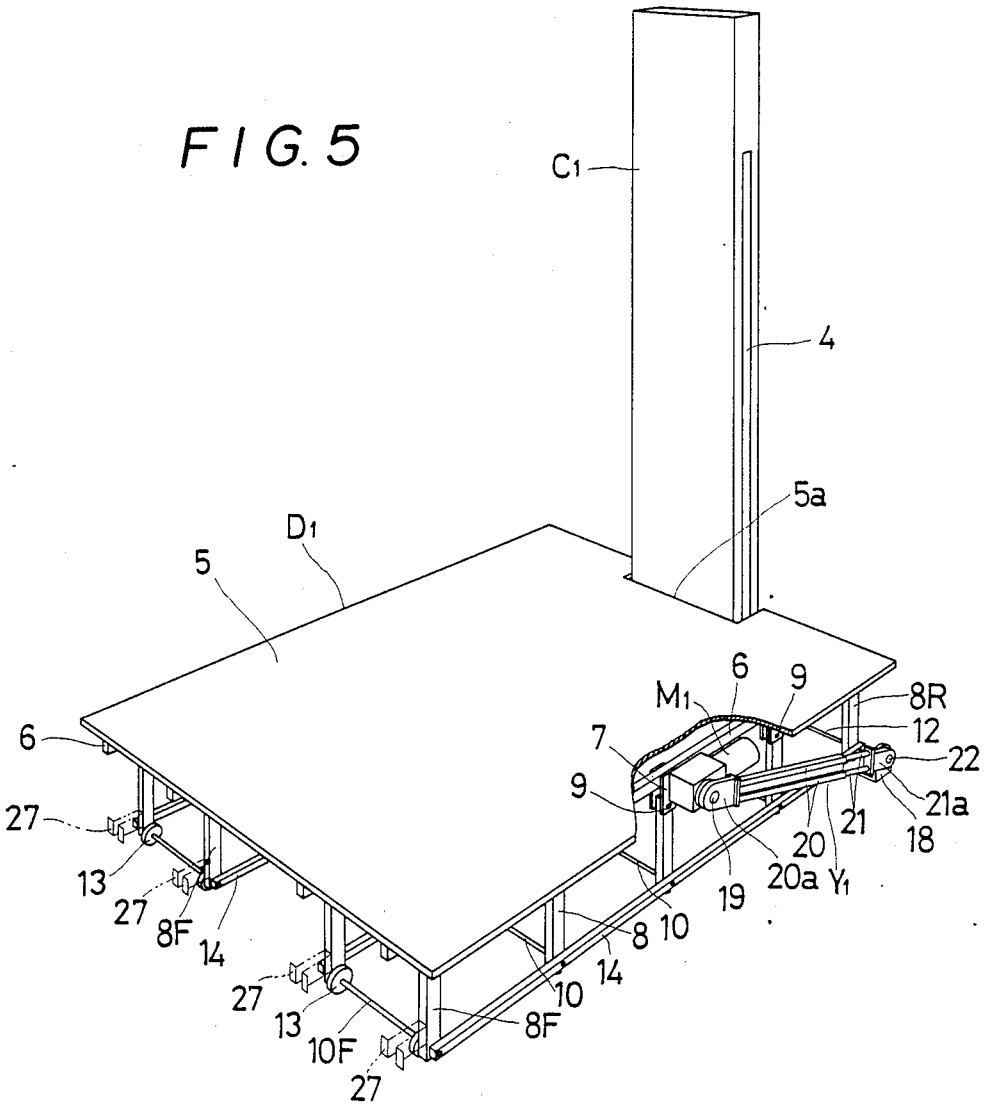

FIGS. 1 to 7 illustrate a high-type folding stage system which embodies the invention in one preferred form. The illustrated high-type folding stage system includes three central guide posts $C_1$, two side guide posts $C_2$ and two outermost guide posts $C_3$. All these guide posts have rectangular shapes, and are illustratively of heights of approximately 5 meters. The guide posts may be fixed to a wall A of, e.g., a gymnasium (FIG. 2). The two guide posts $C_2$ have smaller widths than the other guide posts. The seven guide posts are spaced apart from one another along the wall A. Three central stage components $D_1$ are provided in conjunction with the three central guide posts $C_1$, respectively. FIG. 5 shows one of the stage components $D_1$. Each stage component $D_1$ includes a platform 5 illustratively having a length of approximately 4 meters and a width of approximately 3 meters. Two side stage components $D_2$ are provided in conjunction with the two side guide posts $C_2$, respectively. Each side stage component $D_2$ also includes a platform 5 illustratively having a length of approximately 4 meters and a width of approximately 1 to 1.5 meters. All the stage components $D_1$ and $D_2$ are illustratively of heights of approximately 0.8 meter.

The letter E designates a rectangular front wall, or proscenium wall, of the stage system. This wall E has a central rectangular opening 23. The wall E is illustratively of a height of approximately 6.5 meters and a length of approximately 14.5 meters. A lower portion of the wall E is interconnected to the five stage components $D_1$ and $D_2$.

Two side link mechanisms F are provided in conjunction with the two outermost guide posts $C_3$, respectively. One of the side link mechanisms F connects the proscenium wall E and one of the guide posts $C_3$. The other side link mechanism F connects the proscenium wall E and the other guide post $C_3$.

The letter G designates a central link mechanism.

The construction of each of the above-mentioned major parts of the stage system will now be described in more detail.

(1) Constructions of the guide posts

Figure 6:
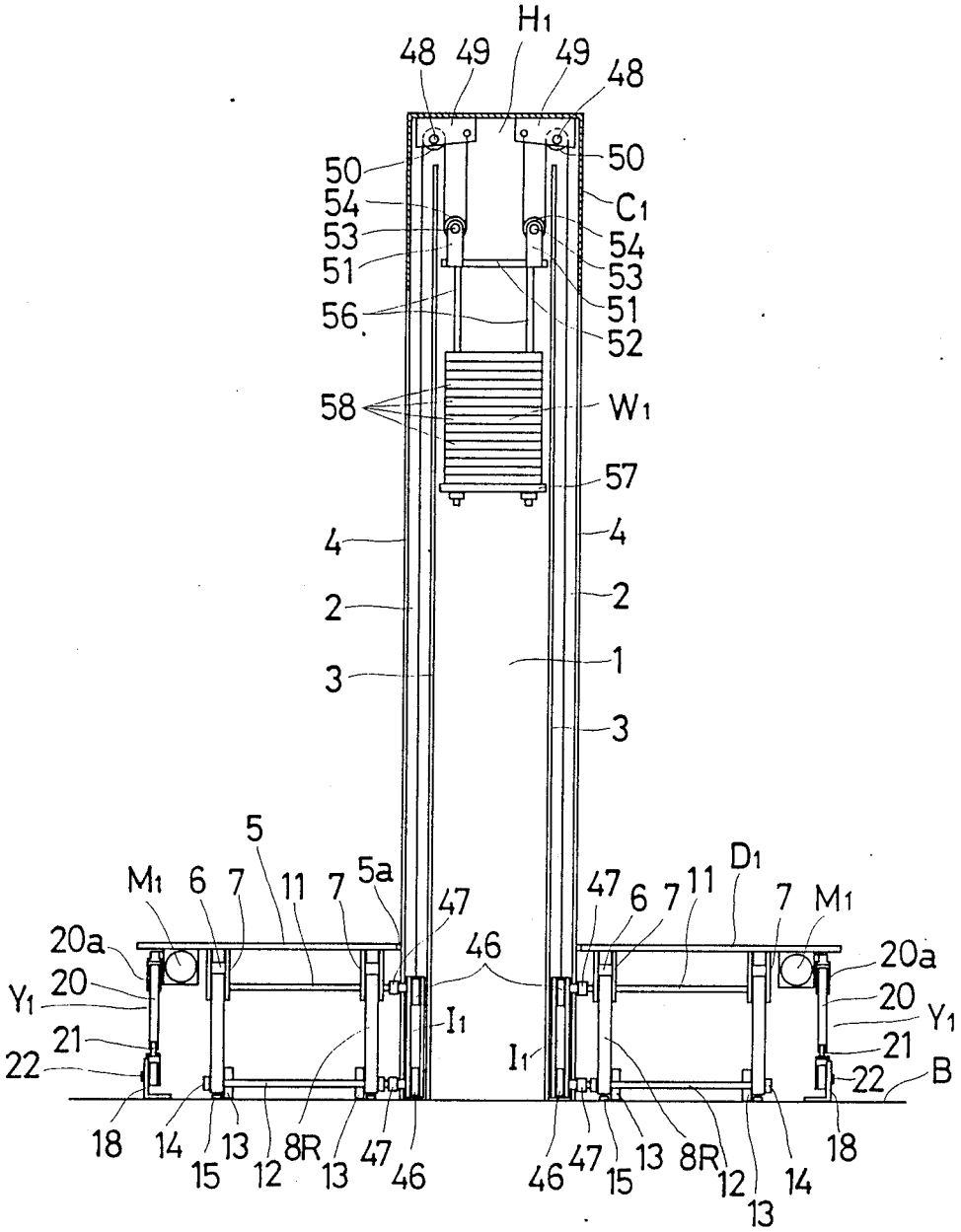
Figure 7:
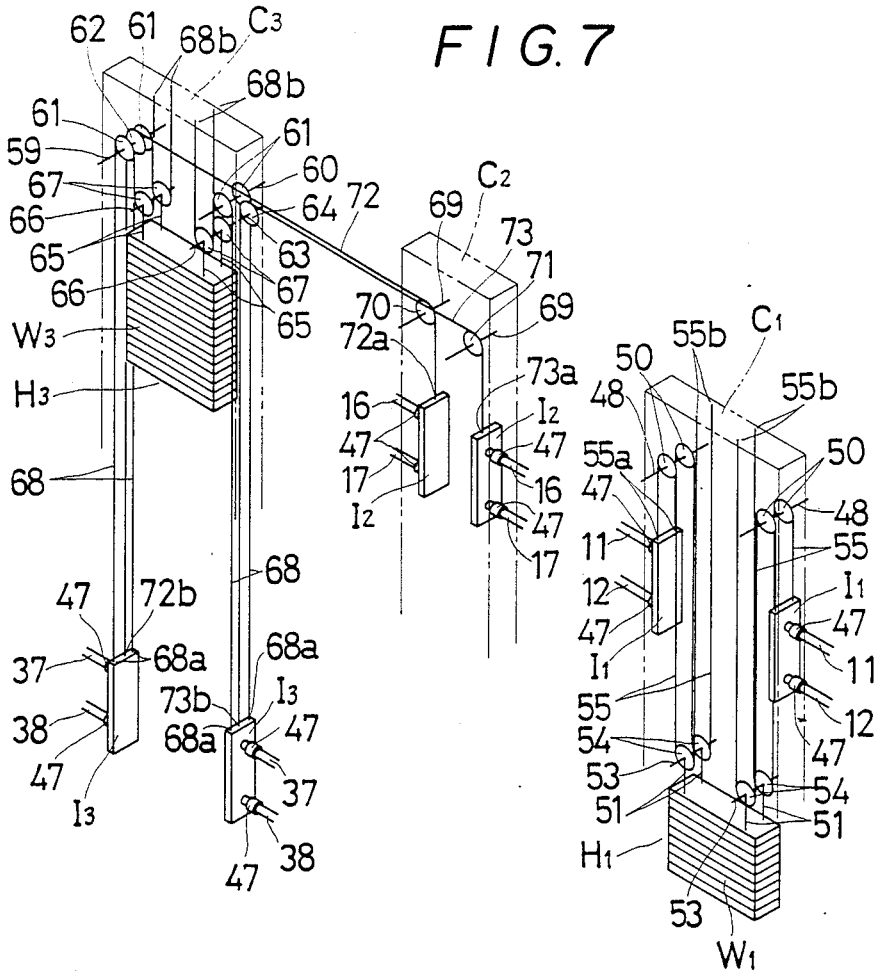

Each of the guide posts $C_1$, $C_2$ and $C_3$ includes an enclosing wall which defines an inner space. As mentioned before, the central guide posts $C_1$ are three in number. Each guide post $C_1$ has a balancer $H_1$ therein (FIGS. 6 and 7). The construction of this balancer is illustrated in more detail in FIG. 4 of the drawings of Japanese Patent Application No. 60-298461.

Neither of the two side guide posts $C_2$ has no balancer therein (FIG. 7). Thus, as mentioned before, each side guide post $C_2$ has a smaller width than the other guide posts. That is, each post $C_2$ is illustratively of a width substantially equal to half the width of the central post $C_1$.

Each of the two outermost guide posts $C_3$ has a balancer $H_3$ therein (FIG. 7).

All the guide posts have rectangular horizontal cross sections. The entire inner space of each of all the guide posts is generally divided into an inner large chamber 1 and outer small chambers 2 by a pair of opposed vertical partition walls 3 as illustrated in FIG. 6.

A pair of rectangular support pieces $I_1$ are located in the outer chambers 2 of each central guide post $C_1$, respectively. Similarly, a pair of rectangular support pieces $I_2$ are located in the outer chambers 2 of each side guide post $C_2$, respectively, and a pair of rectangular support pieces $I_3$ are located in the outer chambers 2 of each outermost guide post $C_3$, respectively. All the support pieces are vertically movable.

Each of all the guide posts has a pair of vertical guide grooves 4 in the side walls thereof, respectively. The grooves 4 extend through the entire thicknesses of the side walls.

(2) Constructions of the central stage components

As mentioned before, in the illustrated embodiment one stage component $D_1$ is provided in conjunction with each central guide post $C_1$. The platform 5 of each central stage component $D_1$ has a recess 5*a* at the rear end portion thereof as shown in FIG. 5. The associated central guide post extends through the recess 5*a*. As shown in FIG. 5, two pairs of beams 6 are fixed to the bottom of the platform 5.

Also as shown in FIG. 5, five support legs 8F, 8 and 8R are connected to each beam 6 by means of connecting members 7 and 7R. The connecting members 7R (FIG. 2) are rearmost connecting members which connect the rearmost support leg 8R to the beam 6. The foremost support leg 8F and the three middle support legs 8 are connected to the associated connecting members 7 by means of pivotal pins 9. The rearmost support leg 8R is connected to the associated connecting members 7R by means of a pivotal rod 11 (FIGS. 2 and 6). This rod 11 not merely connects the support leg 8R to the connecting members 7R, but also extends towards the associated central guide post $C_1$ and connects the opposed, partnered rearmost support leg 8R to the connecting members 7R a associated therewith and further extends towards the associated central guide post $C_1$ and is fixedly received by a rod support 47 which projects outwardly from the outer surface of the support piece $I_1$ located in one of the opposed outer chambers 2 of the associated central guide post. Thus the rod 11 also connects the opposed rearmost legs 8R to each other.

Also, all the support legs connected to the beam 6 are connected at the lower portions thereof to the opposed support legs which are connected to the opposed partnered beam 6, by means of rods. The rod connecting the opposed foremost support legs 8F is designated by reference numeral 10F. The rods connecting the opposed middle support legs 8 are designated by reference numeral 10. The rod connecting the opposed rearmost support legs 8R is designated by reference numeral 12. The opposed end portions of each rod (10 or 12) extend through and project from the associated opposed support legs, and connect lower opposed beams 14 pivotally to the opposed rows of the support legs. Like the upper rearmost rod 11, the lower rearmost rod 12 is fixedly received at the inner end thereof by a rod support 47 which projects outwardly from the outer surface of the support piece $I_1$ (FIG. 6).

A wheel 13 is provided in conjunction with each foremost support leg 8F (FIGS. 2 and 5). The wheel 13 is located inwardly of the support leg 8F, and is mounted on the foremost rod 10F. The wheel 13 is formed of hard rubber at the circumference thereof, and enables the stage component $D_1$ to move smoothly on a floor B. No wheel is provided in conjunction with the three middle support legs 8 and the rearmost support leg 8R. Instead, a base member 15 is provided in conjunction with each of these support legs 8 and 8R. The base member 15 is connected to the bottom of the support leg. Thus the support legs 8 and 8R rest on the floor B through the base members 15. Thanks to the presence of the base members 15 the heights of the support legs 8 and 8R from the floor B are the same as the heights of the foremost support legs 8F from the floor B.

(3) Constructions of the side stage components

Each of the two side stage components $D_2$ has substantially the same construction as the central stage component $D_1$. A major difference is that the side stage component $D_2$ has only one pair of beams 6 fixed to the bottom of the platform 5. A minor difference is that in the side stage component $D_2$ lower beams 14 are connected to the insides of the support legs.

(4) Constructions of electrically-operated mechanisms for folding or unfolding the central stage components Each central stage component $D_1$ has a pair of geared motors $M_1$ connected to the bottom of the platform 5 (FIG. 6). Each geared motor $M_1$ is rotatable in either of opposed directions. One of the geared motors $M_1$ is located by the side of one of the upper outermost beams 6. The other geared motor $M_1$ is located by the side of the other upper outermost beam 6. Each motor $M_1$ has an outwardly-projecting output shaft 19. The shaft 19 has a torque limiter (not shown) therein. Reference numeral 20 designates a pair of elongate, hollow rectangular members which are formed integrally with each other. The elongate members 20 are connected to the output shaft 19 by means of a connecting means **20*a* which is fixed to the shaft 19. A pair of rods 21 are received in the respective elongate members 20. One end of each rod 21 is fixed to a connecting means 21*a*. The connecting means 21*a* is connected to a support means 18 by a pivot 22. The support means 18 is fixed to the floor B, and is located in close proximity to the wall A (FIG. 2). If desired, however, the support means 18** may be fixed to the lower end of the wall A instead of the floor B.

Each rod 21 has a free end in the associated elongate member 20, and is slidable therein along the length thereof.

The motor $M_1$, the elongate members 20 and the slidable rods 21 constitute a mechanism for moving the stage component $D_1$ on the floor B, or folding it to an upright position (FIG. 3) which is immediately in front of the associated central guide post $C_1$ or unfolding it to the horizontal position of FIG. 1. In addition, it may be said that the elongate members 20 and the slidable rods 21 constitute a swing arm member $Y_1$.

When the foregoing stage folding mechanism folds or unfolds the central stage component, the rods 21 slide in the respective elongate members 20 and, thus, the distance between the motor shaft 19 and the pivot 22 is varied.

The two side stage components $D_2$ have no stage folding mechanism.

(5) Construction of the proscenium wall

The proscenium wall E comprises an inner construction and an outer covering 30.

The inner construction includes a base 24, two pairs of side vertical ladder-shaped members 28 and an upper horizontal ladder-shaped member 29. The outer covering 30 covers not only the entire front of the inner construction but also the top of the base 24. The portion of the outer covering 30 which covers the top of the base 24 is level with the platforms 5 of the stage components $D_1$ and $D_2$.

The base 24 is provided with wheels 25 at the bottom thereof. The wheels 25 enables the proscenium wall E to be moved toward or away from the guide posts.

The lower portion of the base 24 is connected to the foremost support legs 8F of each of the five stage components by means of connecting means 27 (FIGS. 2, 3 and 5).

The outer covering 30 may be formed of, for example, a decorative laminated sheet.

(6) Constructions of the side link mechanisms F

Referring to FIGS. 1 and 2, the construction of each side link mechanism F is substantially the same as that which would be obtained if the central stage component $D_1$ were turned upside down.

Each side link mechanism F includes a rectangular plate 31 corresponding to the platform 5 of the central stage component. Two pairs of opposed beams 32 are fixed to the upper surface of the plate 31. A row of five uprights 34 are connected to each beam 32 by means of connecting members 33. The foremost upright 34F and the three middle uprights 34 of each row are connected to the associated connecting members 33 by means of pivotal pins 35, respectively. Likewise, the rearmost upright 34R of each row is connected to the associated connecting members 33 by a pivotal rod 38. However, the pivotal rod 38 extends toward the opposed, partnered rearmost upright 34R and also connects this partnered rearmost upright 34R to the connecting members 33 associated therewith. Thus the pivotal rod 38 connects the opposed, partnered rearmost uprights 34R.

Also, all the uprights 34F, 34 and 34R of each row are connected at the upper portions thereof to the opposed, partnered uprights of the opposed row by, means of upper connecting rods. The upper connecting rods which connect the partnered foremost and three middle uprights 34F and 34 are designated by reference numeral 36 (FIG. 2). The upper connecting rod which connects the partnered rearmost uprights 34R is designated by reference numeral 37. In addition, the opposed end portions of each connecting rod extend through and project from the associated uprights, and connect opposed upper beams 40 pivotally to the opposed rows of the uprights.

The inner end portions of the rods 37 and 38 project toward the associated outermost guide post $C_3$, and are fixedly received by rod supports 47 which project outwardly from the outer surface of the support piece $I_3$ located in one of the opposed outer chambers 2 of the associated guide post (FIG. 7).

A pair of boxes 39 are associated with the two pairs of the rows of the uprights (FIGS. 1 and 2). Each box 39 has a front surface fixed to the inner surface of one of the side vertical ladder-shaped members of the proscenium wall E. The rear portion of the box 39 is located between the partnered, opposed foremost uprights 34F. The foremost rod 36 connecting the partnered, opposed foremost uprights 34F extends through the top of the rear portion of the box 39 between the opposed foremost uprights 34F. The rear portion of the box 39 is thus supported by the foremost connecting rod 36.

(7) Constructions of electrically-operated mechanisms for folding or unfolding the side link mechanisms F Referring to FIGS. 1 and 2, each side link mechanism F includes a pair of geared motors $M_2$ fixed on the upper surface of the plate 31. These motors are located with the two pairs of the rows of the uprights between. Each motor $M_2$ is rotatable in either of opposed directions. Each motor $M_2$ has an outwardly-projecting output shaft 42. The shaft 42 has a torque limiter (not shown) therein. Reference numeral 43 designates a pair of elongate, hollow rectangular members which are formed integrally with each other. The elongate members 43 are connected to the output shaft 42 by means of a connecting means **43*a* which is fixed to the shaft 19. A pair of rods 44 are received in the respective elongate members 43. One end of each rod 43 is fixed to a connecting means 44*a*. The connecting means 44*a* is connected to a support means 41 by a pivot 45. The support means 41** is fixed to the wall A.

Each rod 44 has a free end in the associated elongate member 43, and is slidable therein along the length thereof.

The motor $M_2$, the elongate members 43 and the slidable rods 44 constitute a mechanism for folding the side link mechanism F to an upright position (FIG. 4) which is immediately in front of the associated outermost guide post $C_3$ or unfolding it to the horizontal position of FIG. 1. In addition, it may be said that the elongate members 43 and the slidable rods 44 constitute a swing arm member $Y_2$.

When the foregoing folding mechanism folds or unfolds the side link mechanism F, the rods 44 slide in the respective elongate members 43 and, thus, the distance between the motor shaft 42 and the pivot 45 is varied.

Thus the foregoing folding mechanism for the side link mechanism is essentially the same as the folding mechanism for the central stage component in construction.

(8) Description of the support pieces

As mentioned before, a pair of rectangular support pieces are located in the outer chambers 2 of each guide post, respectively. The support pieces in the central guide post $C_1$ are designated by $I_1$. The support pieces in the side guide post $C_2$ are designated by $I_2$. The support pieces in the outermost guide post $C_3$ are designated by $I_3$.

Although not shown in FIG. 7, a pair of front and rear guide rollers 46 are provided above each support piece and likewise a pair of front and rear guide rollers 46 are provided below each support piece (FIG. 6). The front rollers 46 roll on and along the inner surface of the front wall of the guide post while the rear rollers 46 roll on and along the inner surface of the rear wall of the guide post. Thus the rollers 46 facilitates the vertical movements of the support pieces in and along the outer chambers 2 of the guide post.

The previously-mentioned rod supports 47 project outwardly from the outer surface of each support piece through the guide groove 4 of the guide post. As mentioned before, the rod supports 47 fixedly support the inner end portions of the upper and lower rods connecting the opposed rearmost support legs of the stage component to each other.

(9) Description of the balancer

As described before, each of the three central guide posts $C_1$ has a balancer $H_1$ therein and each of the two outermost guide posts $C_3$ has a balancer $H_3$ (FIG. 7). The side guide posts $C_2$ have no balancer.

Referring to FIGS. 6 and 7, the balancer $H_1$ in each central guide post includes a counterweight $W_1$ located in the inner chamber 1 of the post. The counterweight $W_1$ comprises a plurality of horizontal weight plates 58. The plates 58 are supported by a pair of front vertical bars 56 and a pair of rear vertical bars 56. However, the rear vertical bars 56 are not shown in FIG. 6. All the bars 56 extend through the plates 58. The plates 58 are placed on a bottom support plate 57. The lower end portions of the bars 56 extend through the plate 57. The front bars 56 and the rear bars 56 are suspended from a pair of front and rear horizontal support members 52, respectively. Only the front support member 52 is shown in FIG. 6. The front support member 52 is in turn suspended from a pair of front vertical support members 51. Similarly, the rear support member 52 is suspended from a pair of rear vertical support members 51 (not shown). A pin 53 extends through the upper ends of the right-hand front and rear vertical support members 51. Also a pin 53 extends through the upper ends of the lefthand front and rear vertical support members 51. A pair of front and rear vertically-movable sprockets 54 are provided around each pin 53. The sprockets 54 are located inwardly of the vertical support members 51.

A pair of front top plates 49 are fixed to the top of the central guide post. Also, although not shown in FIG. 6, a pair of rear top plates 49 are fixed to the top of the central guide post. A pin 48 extends through the right-hand front and rear top plates 49. Also a pin 48 extends through the left-hand front and rear top plates 49. A pair of front and rear sprockets 50 are provided around the right-hand pin 48, and are located between the right-hand front and rear top plates 49. Also, a pair of front and rear sprockets 50 are provided around the left-hand pin 48, and are located between the left-hand front and rear top plates 49.

A first chain 55 is fixed to the front left-hand top plate 49 at an upper end **55*b* thereof. The first chain 55 extends downward and engages the front left-hand vertically-movable sprocket 54**. And thence the first chain 55 extends upward and engages the upper, front left-hand sprocket 50 and thence extends downward into the left-hand outer chamber 2 and is fixed at a lower end 55*a* thereof to the rectangular support piece $I_1$ located in the left-hand outer chamber 2.

A second chain 55 is fixed to the rear left-hand top plate 49 at an upper end 55*b* thereof. The second chain 55 extends downward and engages the rear left-hand vertically-movable sprocket 54. And thence the second chain 55 extends upward and engages the upper, rear left-hand sprocket 50 and thence extends downward into the left-hand outer chamber 2 and is fixed at a lower end 55*a* thereof to the rectangular support piece $I_1$ located in the left-hand outer chamber 2.

A third chain 55 is fixed to the front right-hand top plate 49 at an upper end 55*b* thereof. The third chain 55 extends downward and engages the front right-hand vertically-movable sprocket 54. And thence the third chain 55 extends upward and engages the upper, front right-hand sprocket 50 and thence extends downward into the right-hand outer chamber 2 and is fixed at a lower end 55*a* thereof to the rectangular support piece $I_1$ located in the right-hand outer chamber 2.

A fourth chain 55 is fixed to the rear right-hand top plate 49 at an upper end 55*b* thereof. The fourth chain 55 extends downward and engages the rear right-hand vertically-movable sprocket 54. And thence the fourth chain 55 extends upward and engages the upper, rear right-hand sprocket 50 and thence extends downward into the right-hand outer chamber 2 and is fixed at a lower end 55*a* thereof to the rectangular support piece $I_1$ located in the right-hand outer chamber 2.

Like the balancer $H_1$, the balancer $H_3$ in each outermost guide post $C_3$ includes a counterweight $W_3$ located in the inner chamber 1 of the post (FIG. 7). The counterweight $W_3$ comprises a plurality of horizontal weight plates. Although not shown, the construction supporting these weight plates is the same as the construction supporting the weight plates 58 of the foregoing balancer $H_1$. As with the balancer $H_1$, a pair of right-hand front and rear sprockets 67 and a pair of left-hand front and rear sprockets 67 are provided. The construction supporting these sprockets 67 is the same as the construction supporting the corresponding sprockets 54 of the balancer $H_1$.

Three aligned sprockets 61, 62 and 61 are provided in proximity to the top of the guide post $C_3$. These sprockets 61, 62 and 61 are located on the left side of the inner space of the guide post. The sprockets 61, 62 and 61 are supported by a pin 59 which extends therethrough. Also, two aligned sprockets 61 and 61 are provided at the same level as the sprockets 61, 62 and 61. These sprockets 61 and 61 are located on the right side of the inner space of the guide post. In addition, a sprocket 64 is provided at the same level as the sprockets 61 and 61. This sprocket 64 is located nearer to the right-hand side wall of the guide post $C_3$ than the sprockets 61, and is positioned between the sprockets 61 and 61 as viewed from the direction of either side wall of the post. The sprockets 61 and 61 are supported by a pin 60 which extends therethrough. The sprocket 64 is supported by a pin 63 which extends therethrough.

A first chain 68 is fixed to the top of the guide post $C_3$ (to be more exact, a part corresponding to the top plate 49 of the balancer $H_1$) at an upper end 68*b* thereof. The first chain 68 extends downward and engages the front left-hand vertically-movable sprocket 67. And thence the first chain 68 extends upward and engages the upper, left-hand foremost sprocket 61 and thence extends downward into the left-hand outer chamber 2 and is fixed at a lower end 68*a* thereof to the rectangular support piece $I_3$ located in the left-hand outer chamber 2.

A second chain 72 is fixed at one end 72*b* thereof to the support piece $I_3$ in the left-hand outer chamber 2. The second chain 72 extends upward and engages the upper, left-hand middle sprocket 62. And thence the second chain 72 extends horizontally to the right and projects outwardly from an opening of the inner side wall of the guide post and enters the adjacent side guide post $C_2$ through an opening of the opposed side wall of the adjacent side guide post. In this side guide post the second chain 72 engages a left-hand sprocket 70 provided therein, and extends downward and is fixed at an opposed end 72*a* thereof to the support piece $I_2$ located in the left-hand outer chamber 2 of the side guide post.

A third chain 68 is fixed to the top of the guide post $C_3$ (to be more exact, a part corresponding to the top plate 49 of the balancer $H_1$) at an upper end 68*b* thereof. The third chain 68 extends downward and engages the rear left-hand vertically-movable sprocket 67. And thence the third chain 68 extends upward and engages the upper, left-hand rearmost sprocket 61 and thence extends downward into the left-hard outer chamber 2 and is fixed at a lower end 68*a* thereof to the support piece $I_3$ located in the left-hand outer chamber 2.

A fourth chain 68 is fixed to the top (to be more exact, a part corresponding to the top plate 49) of the guide post $C_3$ at an upper end 68*b* thereof. The fourth chain 68 extends downward and engages the front right-hand vertically-movable sprocket 67. And thence the fourth chain 68 extends upward and engages the front one 61 of the upper two right-hand aligned sprockets and thence extends downward into the right-hand outer chamber 2 and is fixed at a lower end 68*a* thereof to the support piece $I_3$ located in the right-hand outer chamber 2.

A fifth chain 73 is fixed at one end 73*b* thereof to the support piece $I_3$ in the right-hand outer chamber 2. The fifth chain 73 extends upward and engages the upper rightmost sprocket 64. And thence the fifth chain 73 extends horizontally to the right through the foregoing opening of the inner side wall of the guide post, and enters the adjacent side guide post $C_2$ through the foregoing opening of the opposed side wall of the guide post $C_2$. In this guide post the fifth chain 73 further extends to the right and engages a right-hand sprocket 71 provided therein and extends downward and is fixed at an opposed end thereof to the support piece $I_2$ located in the right-hand outer chamber 2 of the guide post $C_2$.

A sixth chain 68 is fixed to the top (to be more exact, a part corresponding to the top plate 49) of the guide post $C_3$ at an upper end 68*b* thereof. The sixth chain 68 extends downward and engages the rear right-hand vertically-movable sprocket 67. And thence the sixth chain 68 extends upward and engages the rear one of the two upper right-hand aligned sprockets 61 and thence extends downward into the right-hand outer chamber 2 and is fixed at a lower end 68*a* thereof to the support piece $I_3$ located in the right-hand outer chamber 2.

The foregoing description of the balancer $H_3$ has been made with reference to FIG. 7. That is, the foregoing description has been made of the balancer $H_3$ provided in the left-hand outermost guide post $C_3$. However, the construction of the balancer $H_3$ in the right-hand outermost guide post $C_3$ is the same as the construction of the balancer $H_3$ in the left-hand outermost guide post $C_3$ except that the sprockets of the former balancer $H_3$ corresponding to the left-hand three aligned sprockets 61, 62 and 61 of the latter balancer $H_3$ are located on the right side in the guide post and the sprockets of the former balancer corresponding to the right-hand two aligned sprockets 61 and sprocket 64 of the latter balancer are located on the left side in the guide post.

Since the chains 72 and 73 connect the support pieces $I_3$ in the outermost guide post and the support pieces $I_2$ in the adjacent side guide post, the support pieces $I_2$ are raised when the support pieces $I_3$ are lowered, and vice versa. This mechanism enables the side stage component to be folded or unfolded simultaneously with the side link mechanism. In other words, the operation of the side stage component depends entirely upon that of the side link mechanism. However, it will be appreciated that the rear end of the side link mechanism is lowered when the side link mechanism is folded, while the rear end of the side stage component is raised when the side stage component is folded.

(10) Construction of the central link mechanism G

The central link mechanism G is located above the stage components.

The central link mechanism G comprises poles, connecting rods and means (bars) for supporting the connecting rods.

Five rear poles 74 project from the tops of the five guide posts $C_1$ and $C_2$, respectively. The rightmost rear pole 74 will be called a "first rear pole", and the other rear poles 74 will be called accordingly. Correspondingly, five front poles 75 project from the top of the horizontal ladder-shaped member 29 of the proscenium wall E, and are opposed to the respective five poles 74 on the guide posts. The rightmost front pole 75 will be called a "first front pole", and the other front poles 75 will be called accordingly. All the front and rear poles 75 and 74 are rotatable in horizontal planes.

A pair of first and second horizontal slant rods 77 and 76 are fixed at outer ends thereof to the first front pole 75 and to the first rear pole 74, respectively. The first and second slant rods 77 and 76 extend inwardly, and are connected to a first common vertical pivot 78 at the inner ends thereof.

Similarly, a pair of third and fourth horizontal slant rods 77 and 76 are fixed at outer ends thereof to the second front pole 75 and to the second rear pole 74, respectively. The third and fourth slant rods 77 and 76 extend inwardly, and are connected to a second common vertical pivot 78 at the inner ends thereof. As clearly illustrated in FIG. 1, the third and fourth rods 77 and 76 slant in the same directions as the first and second slant rods 77 and 76.

The first and second pivots 78 are connected to each other by means of a first horizontal transverse rod 79.

A pair of central horizontal slant rods 81 and 80 are fixed at outer ends thereof to the third front pole 75 and to the third rear pole 74, respectively. The central slant rods 81 and 80 extend inwardly, and are connected to a central common vertical pivot 78 at the inner ends thereof. The central slant rods 81 and 80 slant in the same directions as the first to fourth slant rods 77 and 76.

The central pivot 78 and the second pivot 78 are connected to each other by means of a central horizontal transverse rod 82. The second pivot 78 is longer than the first pivot 78, and the top of the second pivot 78 is at a higher level than the top of the first pivot 78. One end of the central transverse rod 82 is connected to the top of the second pivot 78. And the entire central transverse rod 82 is located at a higher level than the first transverse rod 79.

A pair of fifth and sixth horizontal slant rods 77 and 76 are fixed at outer ends thereof to the fourth front pole 75 and to the fourth rear pole 74, respectively. The fifth and sixth slant rods 77 and 76 extend inwardly, and are connected to a third common vertical pivot 78 at the inner ends thereof. As clearly illustrated in FIG. 1, the fifth and six rods 77 and 76 slant in the directions opposite to the first to fourth slant rods.

Similarly, a pair of seventh and eighth horizontal slant rods 77 and 76 are fixed at outer ends thereof to the fifth front pole 75 and to the fifth rear pole 74, respectively. The seventh and eighth slant rods 77 and 76 extend inwardly, and are connected to a fourth common vertical pivot 78 at the inner ends thereof. The seventh and eighth rods 77 and 76 slant in the same directions as the fifth and sixth slant rods 77 and 76.

The third and fourth pivots 78 are connected to each other by means of a second horizontal transverse rod 79.

A support bar 83 is fixed to each of the front and rear poles 75 and 74 at an outer end thereof (FIGS. 1 and 2). The support bar 83 is inclined inwardly and has an inner end fixed to the inner end portion of the associated slant rod. The bar 83 thus serves to support the associated slant rod from above. The support bar 83 has a turnbuckle 84.

The top of the horizontal ladder-shaped member 29 of the proscenium wall E is slightly at a higher level than the tops of the guide posts, and the front slant rods 77 and the support bars 83 associated therewith are at slightly higher levels than the rear corresponding parts 76 and 83 (FIGS. 3 and 4).

The second transverse rod 79 is at the same level as the first transverse rod 79. However the central transverse rod 82 is at a higher level than the first and second transverse rods 79. Also, the central slant rods 81 and 80 are at higher levels than the first to eighth slant rods 77 and 76.

When the stage components are folded, all the slant rods 76, 77, 80 and 81 are also folded. Precisely speaking, when the stage components are folded, all the slant rods turn on the vertical pivots 78 in horizontal planes, with the outer end of each slant rod moving toward the outer end of the partnered slant rod. When the slant rods are thus folded, the central rods 80, 81 and 82 do not go against the side rods 76, 77 and 79 since the central rods are at higher levels than the side rods as mentioned above.

(11) Description of members from which curtains may be hung

Two parallel battens 85 are suspended from the first and third slant rods 77 and from the second and fourth slant rods 76, respectively. Likewise, two parallel battens 85 are suspended from the fifth and seventh slant rods 77, respectively. Tormentors (not shown) may be hung from the respective battens 85. Although omitted from FIG. 1, a single continuous central batten 86 is suspended from the three transverse rods 79 and 82. The central batten 86 is shown in FIG. 2. The central batten 86 is parallel to the battens 85. A teaser (not shown) may be hung from the central batten 86.

As shown in FIG. 2, brackets 88 are fixed to the upper portions of the guide posts $C_1$ and $C_2$, respectively. A batten 87 is suspended from each bracket 88 (FIG. 2). The battens 87 are parallel to the inner surfaces of the guide posts. A scenery curtain (not shown) may be hung from the battens 87.

Also, brackets 90 are fixed to the upper portions of the central guide posts $C_1$, respectively. The brackets 90 are located above the brackets 88. A batten 89 is suspended from each bracket 90. The battens 89 are also parallel to the inner surfaces of the guide posts $C_1$. A screen (not shown) may be hung from the battens 89. Also, flags (not shown) may be supported by the battens 89.

The horizontal ladder-shaped member 29 of the proscenium wall E is provided at the lower surface thereof with rails 91 which extend along the length of the member 29. An act curtain (not shown) may be hung from the rails 91. In addition, a teaser and a pair of legs (not shown) may be hung from the rails 91.

Folding of the stage system

When the stage system is to be folded from its position of FIG. 1 to its position of FIGS. 3 and 4, the geared motors $M_1$ of the central stage components $D_1$ and the geared motors $M_2$ of the side link mechanisms F are operated substantially simultaneously. Then the motor shafts 19 and 42 start to rotate at a very slow speed, or at a very small reduction gear ratio, illustratively of approximately 1/24,000.

Each swing arm member $Y_1$ starts to swing upward about the pivot 22, thereby causing the rear portion of the stage component $D_1$ to start to move upward. Simultaneously, in the guide post $C_1$, the support pieces $I_1$ start to move upward and the counterweight $W_1$ starts to lower. The lowering of the counterweight $W_1$ facilitates the upward movement of the rear portion of the stage component.

Thus the wheels 13 associated with the foremost legs 8F move toward the guide post $C_1$ on the floor B while the middle and rearmost legs 8 and 8R move upward away from the floor B without changing the upright positions thereof (FIG. 2). The central stage component thus becomes folded.

While the central stage component is thus being folded, the rods 21 of the swing arm member $Y_1$ slide in the elongate members 20 thereof relative to the members 20 and, hence, the arm member $Y_1$ increases its length.

Finally the central stage component is folded to an upright position of FIG. 3 adjacent to the guide post.

On the other hand, the rotation of each motor shaft 42 causes the swing arm member $Y_2$ to swing downward about the pivot 45, thereby lowering the rear portion of the side link mechanism F. Simultaneously, in the guide post $C_3$, the support pieces $I_3$ move downward while the counterweight $W_3$ moves upward. The uprights 34F, 34 and 34R move toward the guide post $C_3$ without changing the upright positions thereof. Finally the side link mechanism F is folded to an upright position of FIG. 4 adjacent to the guide post. While the side link mechanism is thus being folded, the rods 44 of the swing arm member $Y_2$ slide in the elongate members 43 thereof relative to the members 43 and, hence, the arm member $Y_2$ increases its length.

Since the side stage component $D_2$ is connected to the side link mechanism F by means of the support pieces $I_2$, the chains 72 and 73 and the support pieces $I_3$, the side stage component is folded in the same manner as the central stage component simultaneously when the side link mechanism is folded.

Since the lower portion of the proscenium wall E is connected to all the stage components by the connecting means 27, the lower portion of the wall E is moved toward the guide posts simultaneously when the stage components are folded. Likewise, since the upper side portions of the wall E are connected to the side link mechanisms F by the boxes 39, the upper portion of the wall E is moved toward the guide posts simultaneously when the side link mechanisms are folded. Thus, the entire wall E is moved uniformly toward the guide posts simultaneously with the folding of the stage components and the side link mechanisms. As a result, the proscenium wall E is stored in a position which is in close proximity to the guide posts (FIGS. 3 and 4). The wall E maintains its vertical position at all times.

Also, when the stage components and the side link mechanisms are folded, all the slant rods 76, 77, 80 and 81 of the central link mechanism G are folded.

Thus, the proscenium wall, the stage components, the side link mechanisms and the central link mechanism are all compactly folded, or stored, to a position adjacent to the guide posts.

It will be appreciated that if curtains are hung from the battens 85, 86, 87 and 89 and from the rails 91, the foregoing constructions can be stored without removing the curtains.

Unfolding of the stage system

When the stage system is to be unfolded to the position of FIG. 1, the geared motors $M_1$ of the central stage components $D_1$ and the geared motors $M_2$ of the side link mechanisms F are operated to rotate the motor shafts 19 and 42 in directions opposite to the directions in which the shafts are rotated to fold the stage system.

Each swing arm member $Y_1$ starts to swing downward about the pivot 22, thereby causing the lower portion of the stage component $D_1$ to start to move forward. Simultaneously, in the guide post $C_1$, the support pieces $I_1$ start to move downward and the counterweight $W_1$ starts to move upward.

Thus the wheels 13 associated with the foremost legs 8F move forward while the middle and rearmost legs 8 and 8R move downward, maintaining the upright positions thereof, until the central stage component is unfolded to the horizontal position of FIG. 1.

On the other hand, the rotation of each motor shaft 42 causes the swing arm member $Y_2$ to swing upward about the pivot 45, thereby raising the lower portion of the side link mechanism F. Simultaneously, in the guide post $C_3$, the support pieces $I_3$ move upward while the counterweight $W_3$ moves downward. The uprights 34F, 34 and 34R move forward while maintaining the upright positions thereof. Finally the side link mechanism F is unfolded to the horizontal position of FIG. 1. Simultaneously when the side link mechanism F is thus unfolded, the side stage component $D_2$ is unfolded in the same manner as the central stage components.

While the stage components and the side link mechanisms are unfolded, the central link mechanism G is also unfolded and the proscenium wall E moves forward.

II. Low-type folding stage system

A low-type folding stage system according to the invention may be obtained by omitting the legs from the stage components of the high-type system and modifying the high-type in other respects required by the omission thereof.

Figure 8:
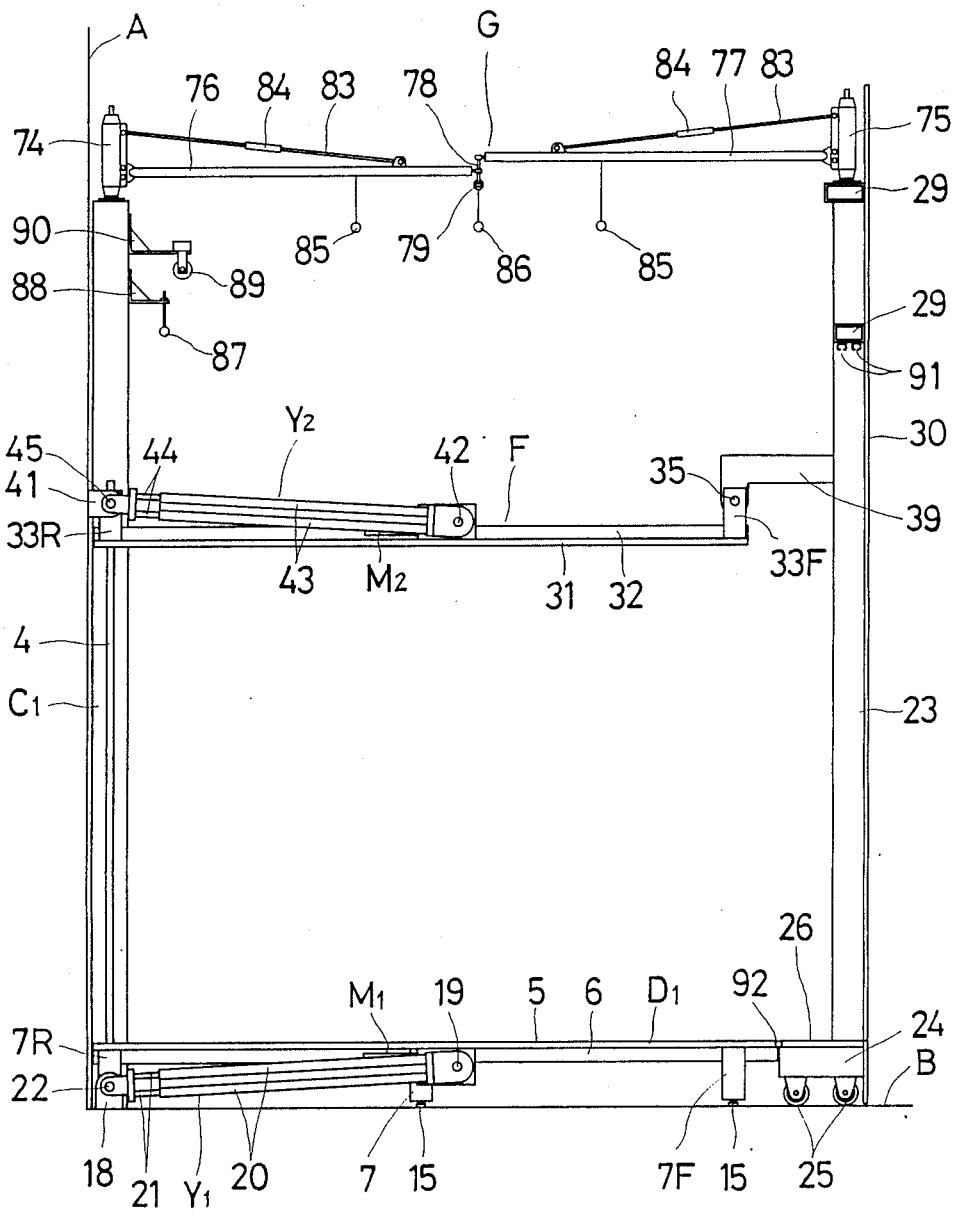
FIG. 8 is a side view of a low-type folding stage system according to the invention.

Such a low-type folding stage system is shown in FIG. 8. In this stage system, stage components and side link mechanisms F are provided with no leg members corresponding to those 8 and 34 of the high-type system. A platform 5 of each stage component has a front end connected to a base 24 of a proscenium wall by means of a pivot 92. Each stage component has no wheel corresponding to the wheel 13 of the high-type system. A horizontal rod (11 or 16) extends through opposed rearmost vertical members 7R projecting downward from the platform 5, and has an inner end supported by a rod support 47 projecting from a central portion of a support piece which is located in the guide post ($C_1$ or $C_2$). Likewise, a horizontal rod 38 extends through opposed rearmost vertical members 33R projecting upward from a plate 31, and has an inner end supported by a rod support 47 projecting from a central portion of a support piece which is located in the outermost guide post. Connecting member 39 corresponding to the boxes 39 of the high-type system project inward from the proscenium wall. Foremost vertical members 33F of the side link mechanism F are connected to the connecting members 39 by means of pivots 35. In the other respects, the construction of the low type system is substantially the same as that of the high-type system.

The platforms 5 of the low-type system are illustratively of heights within a range of 15 to 25 centimeters.

The low-type system may or may not be provided with side stage components corresponding to the side stage components $D_2$ of the high-type system.

What is claimed is:

1. A folding stage system comprising (a) a plurality of guide posts fixed to an indoor or outdoor support wall structure, (b) central stage components provided in conjunction with central ones of said guide posts, respectively, (c) each said central stage component having a platform and a front end portion with wheels to enable said front end portion to move smoothly toward or away from a central guide post on a floor, (d) a flame-shaped proscenium wall having a central opening and fixed to said front end portions of said central stage components at a lower portion thereof, said proscenium wall being provided at the bottom thereof with wheels to enable said proscenium wall to move smoothly toward or away from said guide posts on the floor, (e) side link mechanisms connecting upper portions of two sides of said proscenium wall opposed to each other with said central opening located therebetween to outermost ones of said guide posts, respectively, (f) a pair of opposed operating mechanisms provided for each said central stage component for folding the central stage component to a vertical position adjacent to the associated central guide post or unfolding the central stage component to a horizontal position on the floor, (g) a pair of opposed operating mechanisms provided for each said side link mechanism for folding the side link mechanism to a vertical position adjacent to the associated outermost guide post or unfolding the side link mechanism to a horizontal position above the floor, (h) each said operating mechanism including (i) a geared motor with an output shaft which is rotatable in either of opposed directions and (ii) an extensible swing arm member having one end fixed to said output shaft, (i) each said geared motor for a central stage component being fixed to the central stage component at the substantial middle of the distance between front and rear ends of the central stage component, (j) each said swing arm member for the central stage component having an opposed end connected, for pivotal movement, to a portion of the floor which is in close proximity to said support wall structure, (k) each said geared motor for a side link mechanism being fixed to the side link mechanism at the substantial middle of the distance between front and rear ends of the side link mechanism, (l) each said swing arm member for a side link mechanism having an opposed end connected, for pivotal movement, to said support wall structure, (m) a central link mechanism connecting a top of said proscenium wall to tops of said guide posts, said central link mechanism being folded or unfolded simultaneously with said central stage components and said side link mechanisms, and (n) said proscenium wall being moved toward said guide posts simultaneously with the folding of said central stage components and said side link mechanisms and moving away from said guide posts simultaneously with the unfolding thereof, said proscenium wall maintaining an upright position at all times.

2. A folding stage system of claim 1 further including (a) side guide posts located between said central guide posts and said outermost guide posts, (b) side stage components provided in conjunction with the respective side guide posts and having platforms and front end portions with wheels to enable said front end portions of said side stage components to move smoothly toward or away from said side guide posts on the floor, said proscenium wall being also fixed to front end portions of said side stage components at said lower portion thereof, and (c) interlock means for connecting said side stage components to the respective side link mechanisms in such a manner that said side stage components are folded or unfolded simultaneously with the respective side link mechanisms.

3. A folding stage system in accordance with claim 1 wherein said swing arm member includes (i) a pair of elongate hollow members and (ii) rods having free end portions received in the respective elongate members in such a manner that said free end portions may slide along the lengths of the respective elongate members.

4. A folding stage system in accordance with claim 2 wherein said swing arm member includes (i) a pair of elongate hollow members and (ii) rods having free end portions received in the respective elongate members in such a manner that said free end portions may slide along the lengths of the respective elongate members.

5. A folding stage system in accordance with claim 1 wherein (a) each said guide post has an inner space generally divided into an inner chamber and outer chambers, and has vertical grooves provided in opposed side walls thereof which make said outer chambers communicate with the outside of the guide post, (b) a pair of vertically-movable support means are provided in said outer chambers, (c) a vertically-movable balancer is provided in said inner chamber, (d) means are provided in said inner space for connecting said support means and said balancer for opposite vertical movements, and (e) a rear portion of the central stage component is connected to said support means in the associated central guide post through said grooves therein, and a rear portion of the side link mechanism is connected to said support means in the associated outermost guide post through said grooves therein.

6. A folding stage system in accordance with claim 2 wherein (a) each said guide post has an inner space generally divided into an inner chamber and outer chambers, and has vertical grooves provided in opposed side walls thereof which make said outer chambers communicate with the outside of the guide post, (b) each of said central and outermost guide posts has a pair of vertically-movable support means in said outer chambers, respectively, and has a vertically-movable balancer in said inner chamber thereof, (c) means are provided for connecting said support means and said balancer for opposite vertical movements, (d) each said side guide post has a pair of vertically-movable support means in said outer chambers thereof, respectively, (e) a rear portion of the central stage component is connected to said support means in the associated central guide post through said grooves therein, and a rear portion of the side stage component is connected to said support means in the associated side guide post through said grooves therein, and a rear portion of the side link mechanism is connected to said support means in the associated outermost guide post through said grooves therein, and (f) said interlock means comprises means for connecting said support means in the side guide post and said support means in the adjacent outermost guide post.

7. A folding stage system in accordance with claim 4 wherein (a) each said guide post has an inner space generally divided into an inner chamber and outer chambers, and has vertical grooves provided in opposed side walls thereof which make said outer chambers communicate with the outside of the guide post, (b) each of said central and outermost guide posts has a pair of vertically-movable support means in said outer chambers, respectively, and has a vertically-movable balancer in said inner chamber thereof, (c) means are provided for connecting said support means and said balancer for opposite vertical movements, (d) each said side guide post has a pair of vertically-movable support means in said outer chambers thereof, respectively, (e) a rear portion of the central stage component is connected to said support means in the associated central guide post through said grooves therein, and a rear portion of the side stage component is connected to said support means in the associated side guide post through said grooves therein, and a rear portion of the side link mechanism is connected to said support means in the associated outermost guide post through said grooves therein, and (f) said interlock means comprises means for connecting said support means in the side guide post and said support means in the adjacent outermost guide post.

8. A folding stage system in accordance with claim 1 wherein said central link mechanism comprises (a) rotatable poles mounted on the tops of said guide posts, respectively, (b) rotatable poles mounted on the top of said proscenium wall in conjunction with the respective poles on said guide posts, (c) front horizontal slant members having front ends fixed to the respective poles on said proscenium wall, (d) rear horizontal slant members having rear ends fixed to the respective poles on said guide posts, (e) vertical pivots connecting rear ends of said front slant members and front ends of said rear slant members, respectively, (f) a first transverse member connecting a first of said pivots which connects a first of said front slant members and a first of said rear slant members and a second of said pivots which connects a second of said front slant members and a second of said rear slant members, (g) a second transverse member connecting said second pivot and a third of said pivots which connects a third of said front slant members and a third of said rear slant members, and (h) a third transverse member connecting a fourth of said pivots which connects a fourth of said front slant members and a fourth of said rear slant members and a fifth of said pivots which connects a fifth of said front slant members and a fifth of said rear slant members.

9. A folding stage system of claim 8 further including means suspended from said central link mechanism for hanging curtains.

10. A folding stage system in accordance with claim 1 wherein each said central stage component further includes support legs pivotally connected to a bottom of the platform thereof.

11. A folding stage system in accordance with claim 2 wherein each of said central and side stage components further includes support legs pivotally connected to a bottom of the platform thereof.

* * * * *